US009956580B2

(12) United States Patent
Strock et al.

(10) Patent No.: US 9,956,580 B2
(45) Date of Patent: May 1, 2018

(54) SPRAY MASKING FOR ROTORS

(71) Applicant: United Technologies Corporation, Hartford, CT (US)

(72) Inventors: Christopher W. Strock, Kennebuck, ME (US); Charles R. Beaudoin, Lyman, ME (US); Robert D. Richard, Springvale, ME (US); Steven G. Lemay, Waterboro, ME (US)

(73) Assignee: United Technologies Corporation, Farmington, CT (US)

( * ) Notice: Subject to any disclaimer, the term of this patent is extended or adjusted under 35 U.S.C. 154(b) by 262 days.

(21) Appl. No.: 14/524,331

(22) Filed: Oct. 27, 2014

(65) Prior Publication Data

US 2015/0231665 A1 Aug. 20, 2015

Related U.S. Application Data

(60) Provisional application No. 61/939,959, filed on Feb. 14, 2014.

(51) Int. Cl.

| | |
|---|---|
| ***B05C 21/00*** | (2006.01) |
| ***B05B 15/04*** | (2006.01) |
| ***C23C 4/02*** | (2006.01) |
| ***C23C 4/01*** | (2016.01) |

(52) U.S. Cl.
CPC ..... *B05C 21/005* (2013.01); *B05B 15/045* (2013.01); *C23C 4/01* (2016.01); *C23C 4/02* (2013.01)

(58) Field of Classification Search
None
See application file for complete search history.

(56) References Cited

U.S. PATENT DOCUMENTS

| | | | | |
|---|---|---|---|---|
| 4,559,897 | A * | 12/1985 | Urrea | B05C 5/00 118/406 |
| 6,155,606 | A * | 12/2000 | Phillips | E03D 11/16 285/56 |
| 8,468,969 | B2 | 6/2013 | Beaudoin et al. | |
| 2012/0132138 | A1 | 5/2012 | Beaudoin et al. | |
| 2013/0017338 | A1 | 1/2013 | Strock et al. | |
| 2013/0136864 | A1 | 5/2013 | Strock et al. | |

* cited by examiner

*Primary Examiner* — Jethro M Pence
(74) *Attorney, Agent, or Firm* — Bachman & LaPointe, P.C.

(57) ABSTRACT

A mask for masking a component at an annular boundary comprises a wall (90, 92) having an inner first rim portion having a first inner diameter (D1) and an outward rebate (140) adjacent the first rim portion.

8 Claims, 7 Drawing Sheets

SPRAY MASKING FOR ROTORS

CROSS-REFERENCE TO RELATED APPLICATION

Benefit is claimed of U.S. Patent Application Ser. No. 61/939,959, filed Feb. 14, 2014, and entitled "Spray Masking for Rotors", the disclosure of which is incorporated by reference herein in its entirety as if set forth at length.

BACKGROUND

The disclosure relates to gas turbine engine manufacture. More particularly, the disclosure relates to spray masking for rotors of gas turbine engines.

In gas turbine engines, many components are subject to spray coating of thermal barrier coatings (TBCs), other environmental coatings, and associated bond coats. A number of situations involving gas turbine engine rotors involve applying a coating to an annular surface portion of the rotor while masking an adjacent portion. Examples of such situations involve portions of disks, disk spacers, hubs, and the like. One particular example involves the masking of integrally bladed rotors. One example of an integrally bladed rotor (IBR) involves a single blade stage of a compressor or turbine section of a gas turbine engine. A more particular example is a single high pressure compressor (HPC) stage comprising a disk extending from an inner aperture to an outer rim. A circumferential array of blades protrudes radially from the rim to associated blade tips. Such a disk may be formed via a powder metallurgy process (e.g., of a nickel-based superalloy or a cobalt-based superalloy). The exemplary disk may be forged to near net shape and then subject to machining. An exemplary ultimate configuration involves applying a protective coating away from the airfoils but leaving the airfoils bare. In one such example of such a configuration, the airfoils are super-polished. The airfoils and adjacent areas of disks (e.g., the inter-airfoil spaces on the disk rim) are masked off to allow coating to be applied to remaining portions of the disks.

United States Patent Application Publications 20130136864 A1 of Strock, et al., published May 30, 2013 and entitled "PASSIVE TEMPERATURE CONTROL OF HPC ROTOR COATING" ('864 publication) and 20120132138 A1 of Beaudoin, et al., published May 31, 2012 and entitled "DIMENSIONALLY STABLE DURABLE THERMAL SPRAY MASKING SYSTEM" (the '138 publication) disclose masking systems and methods for such turbine engine rotor components.

SUMMARY

One aspect of the disclosure involves a mask for masking a component at an annular boundary, the mask comprising a wall having an inner first rim portion having a first inner diameter and an outward rebate adjacent the first rim portion.

A further embodiment may additionally and/or alternatively include the mask wall having a second rim portion having a second inner diameter, the second inner diameter larger than the first inner diameter and the outward rebate having an inwardly open channel between the first rim portion and the second rim portion.

A further embodiment may additionally and/or alternatively include the first rim portion having a convex arcuate longitudinal cross section.

A further embodiment may additionally and/or alternatively include the wall being a first wall, the mask having a second wall, spaced apart from the first wall; and the second wall having an inner first rim portion having a first inner diameter and an outward rebate adjacent the second wall first rim portion.

A further embodiment may additionally and/or alternatively include the outer band joining the first wall to the second wall.

A further embodiment may additionally and/or alternatively include the mask comprising a plurality of segments (80) secured end to end.

A further embodiment may additionally and/or alternatively include joints between respective ends of one said segment and another said segment, the segments having interfitting ribs and rebates.

Another aspect involves an assembly comprising the mask and the component.

A further embodiment may additionally and/or alternatively include the mask being compressively engaged to the component at at least three circumferentially spaced locations.

A further embodiment may additionally and/or alternatively include a sealant between the mask and the component.

Another aspect involves a method for using the mask. The method comprises: applying the mask to the component; applying a sealant between the component and the rebate; trimming the sealant; applying a first coating to the component; and removing the mask from the component.

A further embodiment may additionally and/or alternatively include removing the sealant from the mask.

A further embodiment may additionally and/or alternatively include reusing the mask.

A further embodiment may additionally and/or alternatively include reapplying the mask or an identical mask to the component and applying a second coating to the part without a sealant between the component and the rebate.

A further embodiment may additionally and/or alternatively include the first coating being a metallic coating and the second coating being a ceramic coating.

A further embodiment may additionally and/or alternatively include the component being an integrally-bladed rotor and during the applying of the first coating, the mask protecting the blades.

A further embodiment may additionally and/or alternatively include the mask having a plurality of circumferential segments and the applying of the mask to the component comprises assembling the segments end to end and tightening the segments to each other, the tightening closing radial gaps between ends of the segments and the component.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
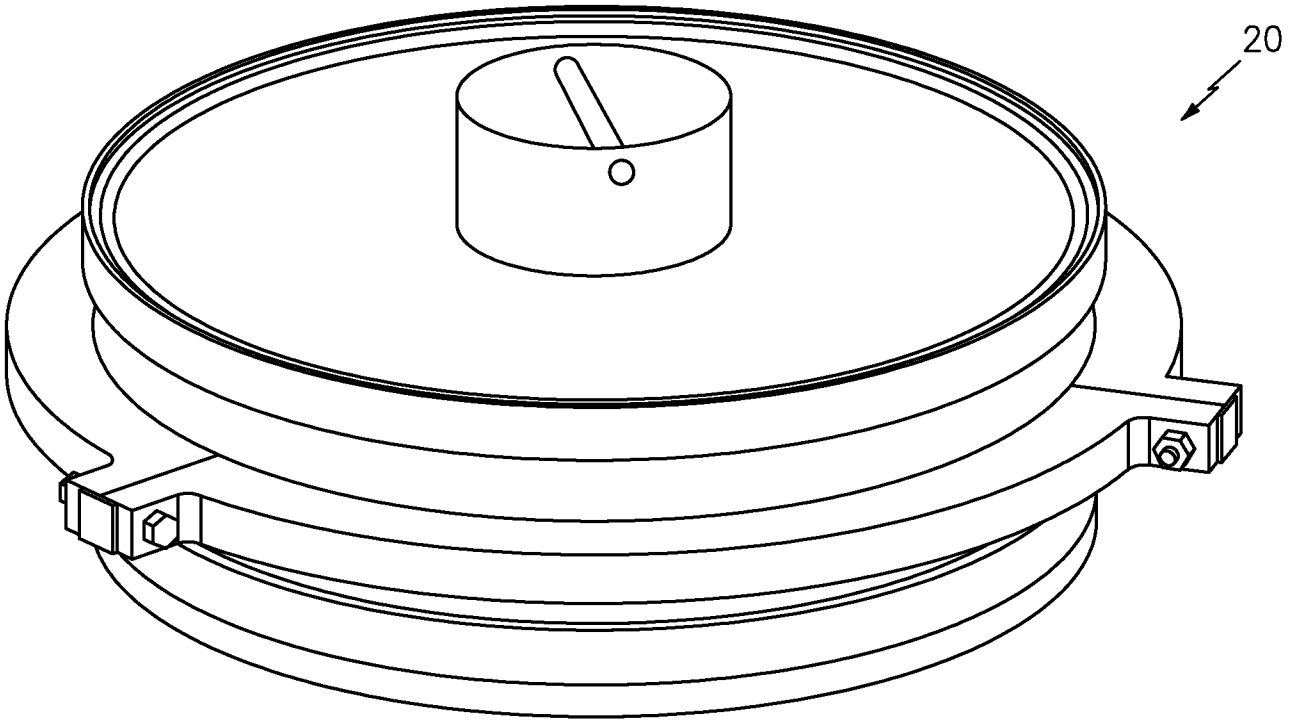
FIG. 1 is a view of a mask assembly.

FIG. 1 shows a gas turbine engine mask assembly 20.

Figure 2:
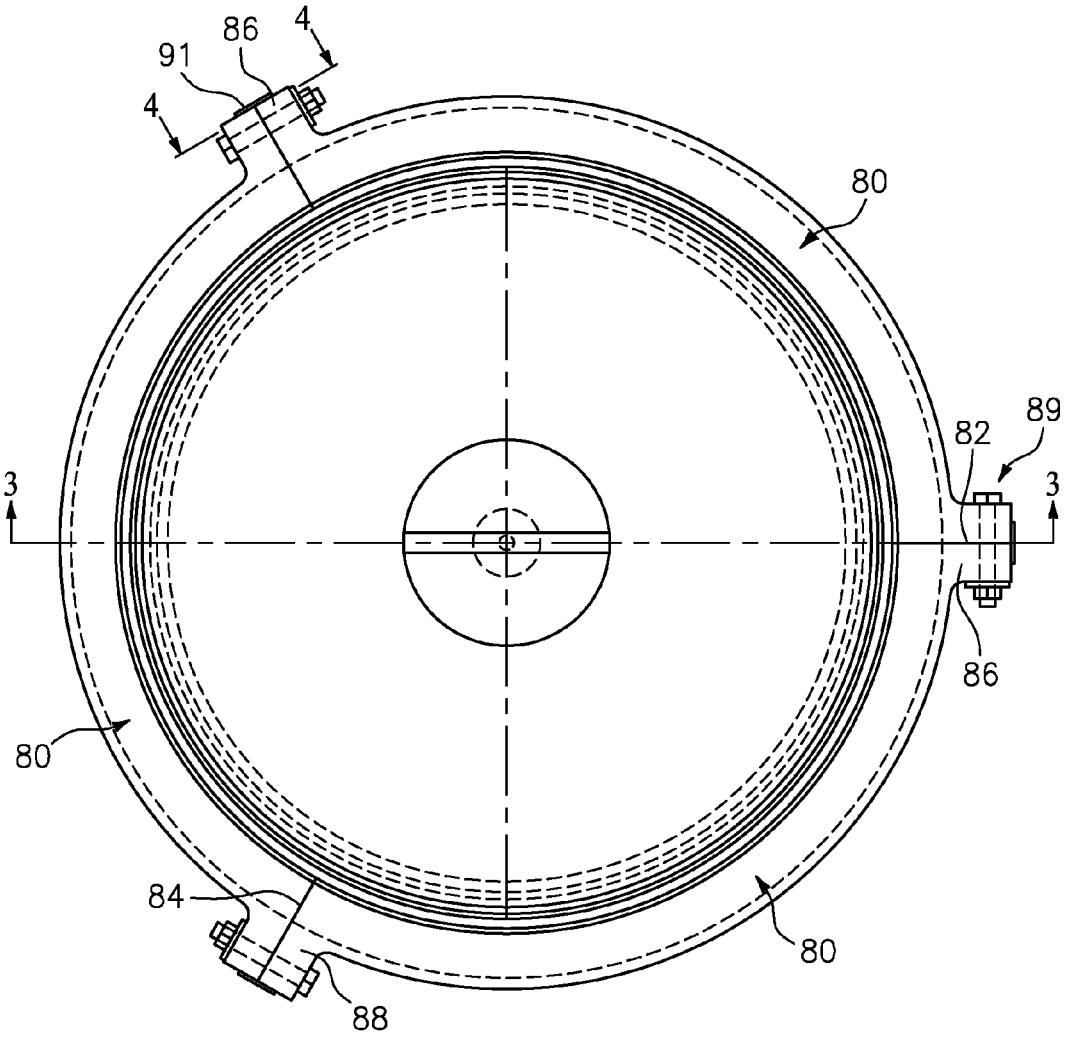
FIG. 2 is an end view of the assembly of FIG. 1.

FIG. 2 is an end view of the mask assembly.

Figure 3:
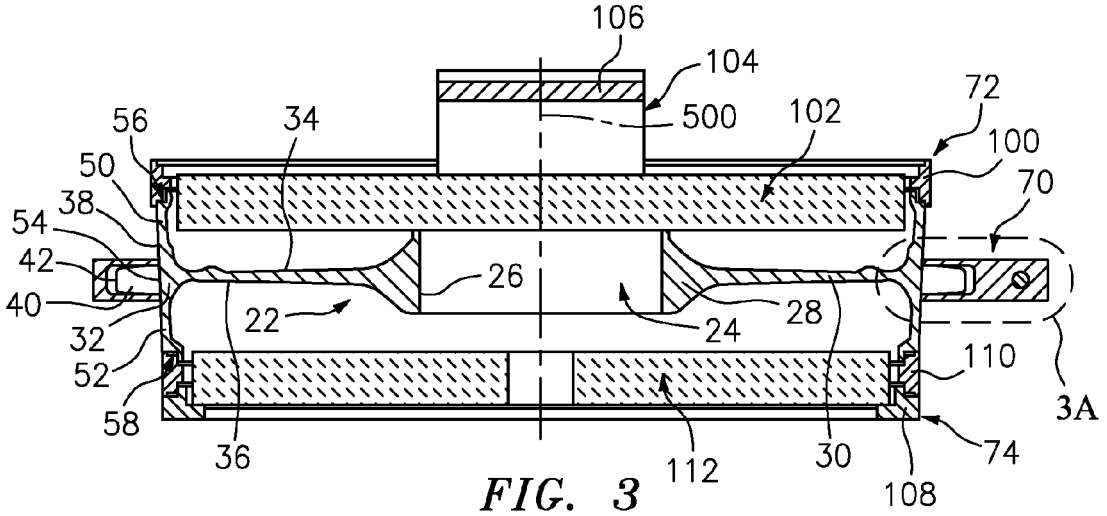
FIG. 3 is a central longitudinal sectional view of the assembly of FIG. 2 taken along line 3-3 and showing a disk carried by the assembly.

Central longitudinal sectional view FIG. 3 shows a disk 22 mounted in the mask assembly 20. The exemplary disk 22 and mask share a central longitudinal axis or centerline 500. The disk comprises a central aperture 24 within the inner diameter (ID) surface 26 of a protuberant disk bore 28. A web 30 of the disk extends radially outward from the bore 28 to a rim 32 and has respective first and second faces 34 and 36. The rim has an outboard or outer diameter (OD) surface 38 from which a circumferential array of blade airfoils 40 extend to respective tips 42. Each exemplary airfoil comprises a leading edge, a trailing edge, a pressure side, and a suction side. The rim further includes annular spacer portions 50 and 52 extending longitudinally beyond roots of the airfoils. The exemplary spacer portions 50 and 52 have distal rim features (e.g., rebates 56, 58) for mating with adjacent disks.

As noted above, it may be desired to apply coating to the rim OD surface 38 along portions of the spacer portions 50 and 52 (e.g., but not along either the central bladed portion 54 or along the features 56 and 58). Accordingly, the exemplary masking system is provided with three main sections: a central section 70 masks the blades and adjacent portions of the surface 38 (e.g., the central bladed portion 54). A first end section 72 masks the feature 56 and portions inboard thereof along the first side of the disk. A second end section 74 masks the feature 58 and portions inboard thereof along the second side of the disk.

Figure 3A:
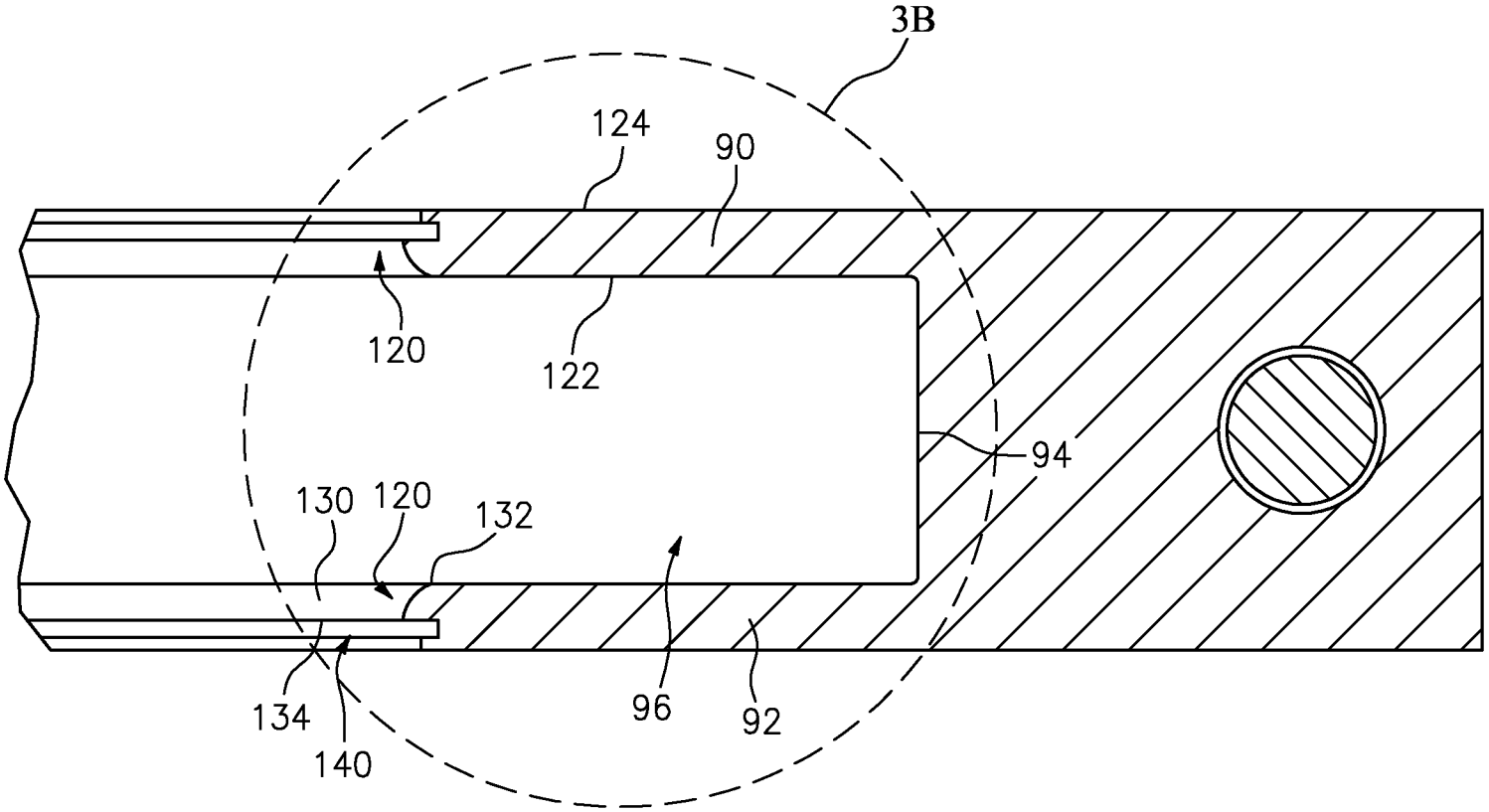
FIG. 3A is an enlarged view of a portion of the mask assembly of FIG. 3.

The exemplary central section 70 is formed as a radially inwardly open channel. More particularly, the exemplary section 70 is formed as an assembly of a plurality of channel segments assembled generally circumferentially end-to-end to form the channel. In the exemplary embodiment, there are a number of identical segments 80 (FIG. 2; e.g., an exemplary three illustrated but, more broadly, two to five). Each exemplary segment 80 extends between a first circumferential end 82 and a second circumferential end 84 and has attachment features at such circumferential ends. Exemplary attachment features comprise radially protruding ears or flanges 86 and 88 (e.g., with tangential holes for bolting 89 to the adjacent flange of the adjacent segment). Each exemplary segment 80 comprises first and second radial flanges or webs (end walls when viewed in section or simply just "walls") 90 and 92 (FIG. 3A). The walls 90 and 92 extend radially from free inboard extremities (rims) to outboard extremities joined by a band portion 94. The band portion 94 forms a base of a radially inwardly open channel 96 with the flanges or webs 90 and 92 forming the walls of such channel.

FIG. 2 also shows plates 91 spanning junctions between the ears or flanges 86 and 88. Exemplary plates 91 are attached to one of the ears or flanges 86 and 88 (e.g., by welding) and overlap the other to protect the junction from spray.

Discussed further below, the exemplary mask section 72 comprises outer metallic ring 100 carrying an inner insulator 102. An exemplary insulator 102 is a metal-jacketed ceramic. The insulator 102 may be mounted to the metallic ring 100 by appropriate means. Exemplary means include self-supported stacking via gravity with a clearance fit snap diameter between the outer diameter of the insulator and the inner diameter of the metallic ring. The exemplary insulator carries a stack 104. The exemplary stack is formed as a metallic sheetmetal cylinder secured to the sheetmetal of the insulator and having a handle 106 internally diametrically spanning the stack.

The exemplary mask section 74 also includes metallic member and insulator. More particularly, however, the exemplary mask section 74 includes two members (alternatively characterized as a two-piece member) having a ring-like baseplate member 108 and a ring 110 carried atop the baseplate member. The insulator is shown as 112. The baseplate 108 functions to mount the masked rotor to a rotary table (e.g., via a three-jaw chuck (not shown)). Accordingly, the baseplate 108 is relatively massive. This massiveness may create issues of differential thermal expansion relative to the disk. Accordingly, the mask section 74 has the second metallic ring 110 which is relatively less massive and able to accommodate differential thermal expansion between the disk on the one hand and the baseplate on the other hand. In the exemplary configuration wherein the mask section 74 is a lower section, the insulator 112 may be supported atop an inwardly-directed flange of the baseplate 108 and may have similar gravity and snap diameter arrangement with the exemplary ring 110.

In the exemplary embodiment, the rings 100 and 110 are both symmetric top-to-bottom. This allows each of these rings to be reversed. During coating, the rotary table rotates the masked disk about the axis 500 while the spray guns are fixed circumferentially but may move axially to provide full axial coverage. The spray may cover the outer diameter surfaces of the rings 100 and 110 with coating. Test coupons on the outer diameters of such rings may provide for coating quality verification. However, when the spray reaches the ring 100, it is not desirable that the spray pass diametrically across the upper rim of the ring and reach the opposite internal periphery. In such a situation, accumulation of spray on the interior of the ring 100 near its upper rim would prevent reversal of the ring in use. Accordingly, the stack 104 blocks such overspray from reaching the diametrically opposite inner diameter surface of the ring 100.

Figure 3B:
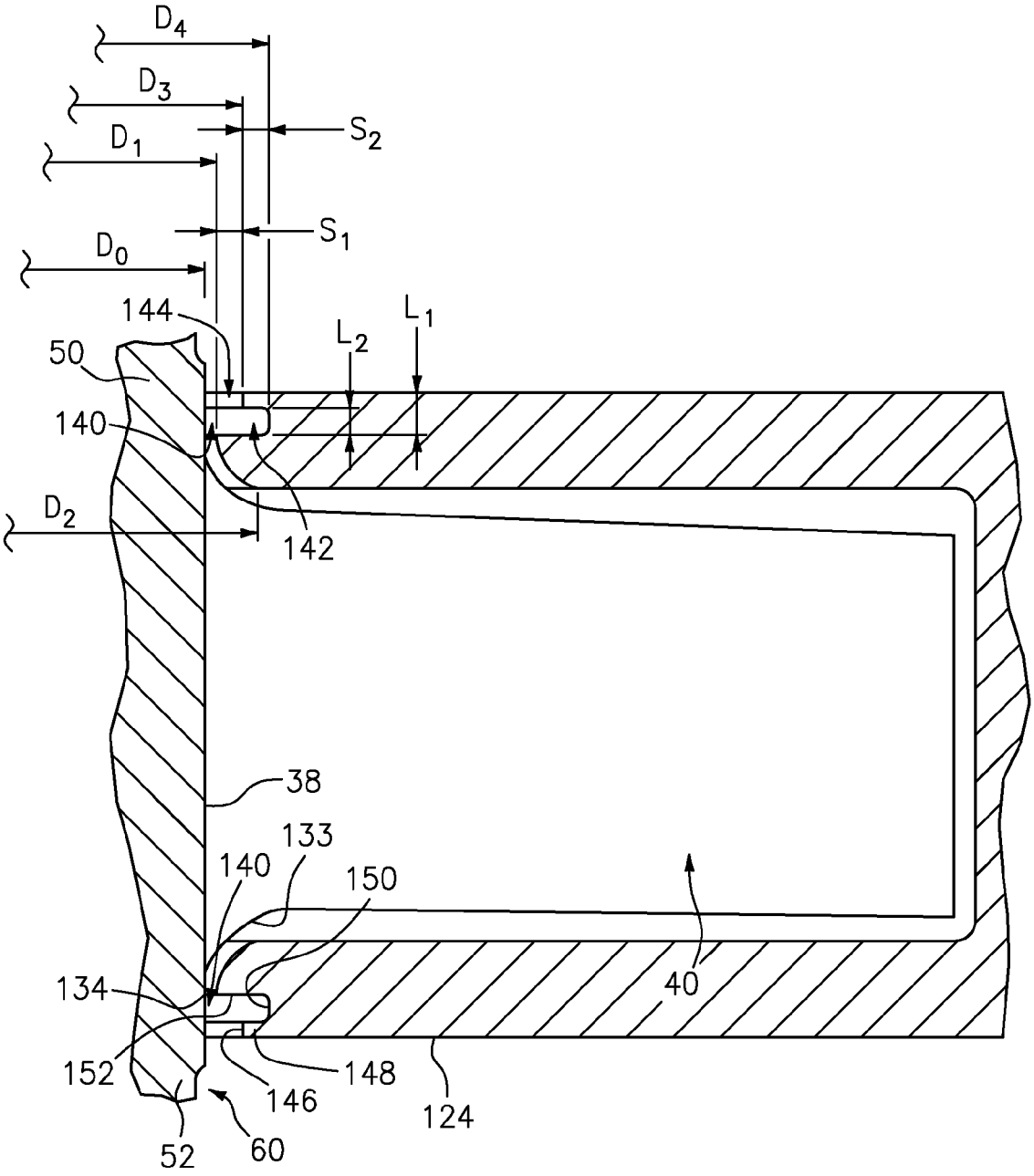
FIG. 3B is an enlarged view of a portion of the mask assembly of FIG. 3A.

FIG. 3A further shows the aforementioned inboard or inner diameter (ID) rims 120 of the walls 90 and 92. FIG. 3A further shows an inner (axially inboard) surface 122 of each wall 90 and 92 and an outer (axially outboard) surface 124. In cross-section, the rim 120 has an inwardly convex surface portion 130 extending from a junction 132 with the inner wall 122 to an inboard terminal end 134 which defines the minimum diameter location of the associated rim 120. FIG. 3B shows the convexity of surface portion 130 closely accommodating (or continuously contacting) fillets 133 at blade leading and trailing edges. FIG. 3B labels the diameter at the minimum diameter location 134 as $D_1$ and the diameter at the junction 132 as $D_2$.

A rebate 140 (FIG. 3B) exists between the extremity 134 and the outer face 124. As is discussed further below, the exemplary rebate is a stepped rebate. The exemplary rebate is stepped with a relatively larger diameter axially inboard portion 142 and a relatively smaller diameter axially outboard portion 144. The exemplary portion 144 extends to the outer surface 124 and has a radially outward base 146 whose diameter is shown as $D_3$ and which forms the inboard extreme or rim of a small lip or rim section 148. The portion 142 is thus formed as a radially inwardly-open channel extending outward from the main rebate section 144. The channel has a base surface 150 whose diameter is shown as $D_4$. An axially inboard surface of the rebate is shown as 152.

FIG. 3B further shows machined coating pockets 60. The exemplary coating pockets are slightly reduced diameter areas along the regions to be coated. The presence of the coating pockets helps facilitate a smooth surface between coated and uncoated areas. For example, after coating application, the coating may be machined flush to intact areas adjacent the pockets. This machining may also remove slight overspray along those adjacent areas.

As is discussed further below, the geometry of the rebate 140 may serve to provide one or more of several useful functions. First, it may capture a sealant/maskant for masking in one or more stages of coating or other processing. Second, the geometry alone may, in the absence of such sealant/maskant serve as a shadow mask in one or more stages of coating and/or other processing. For example, the presence of the rebate portion 142 allows any maskant to key against the rim portion 148 and be retained to the mask. The rebate lacking the portion 142 may perform the functions discussed below while compromising such retention.

An exemplary rebate depth or radial span $S_1$ at the surface 146 is 0.015 inch (0.38 mm). An exemplary rebate longitudinal span $L_1$ is 0.015 inch (0.38 mm). An exemplary depth of the rebate portion 142 radially beyond the portion 144 is shown as $S_2$ with the combined rebate depth being $S_1$ plus $S_2$. Exemplary $S_2$ is 0.010 inch (0.25 mm) to 0.05 inch (1.3 mm), more narrowly, 0.015 inch (0.38 mm) to 0.03 inch (0.76 mm). An exemplary longitudinal span $L_2$ of the channel portion 142 is 0.015 inch (0.38 mm).

Figure 3C:
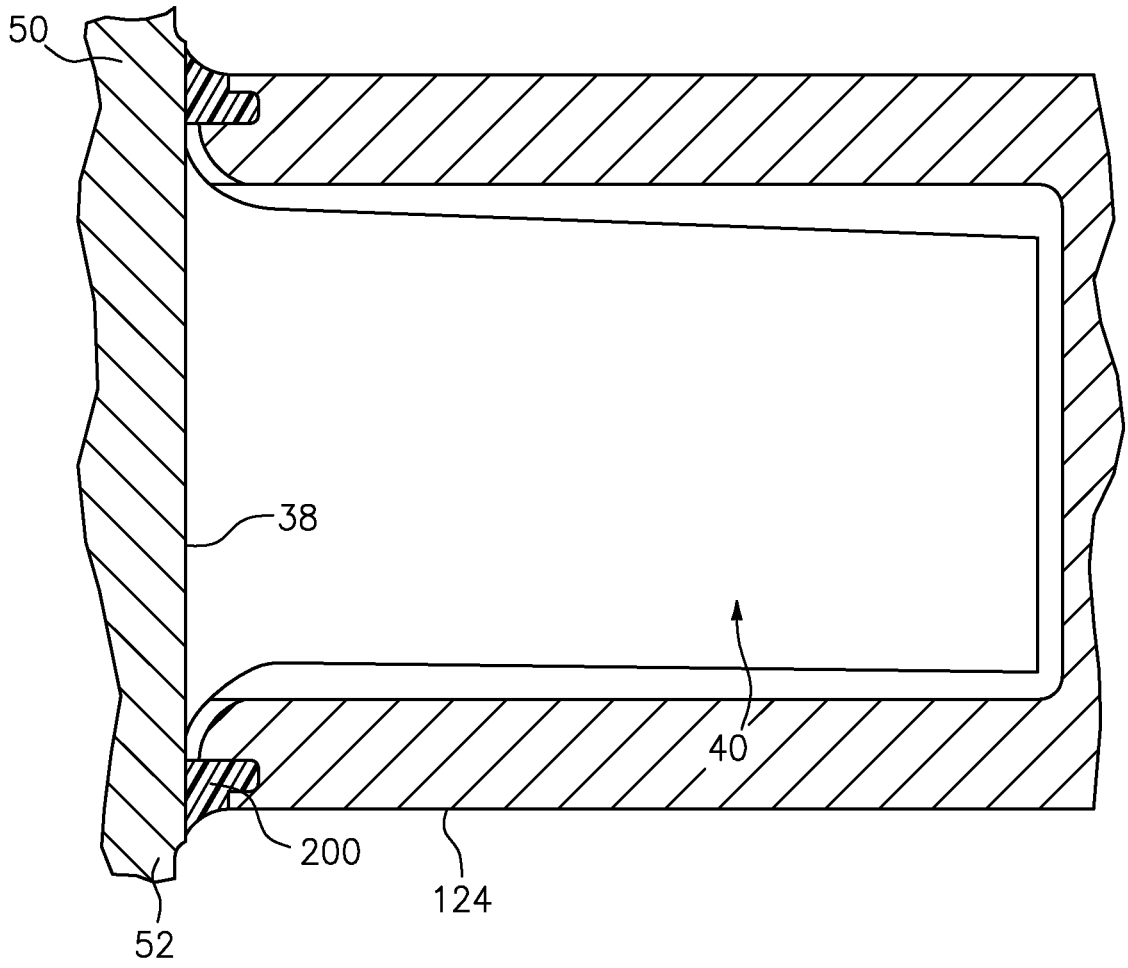
FIG. 3C is a view of the portion of the mask assembly of FIG. 3B after maskant application.
Figure 3D:
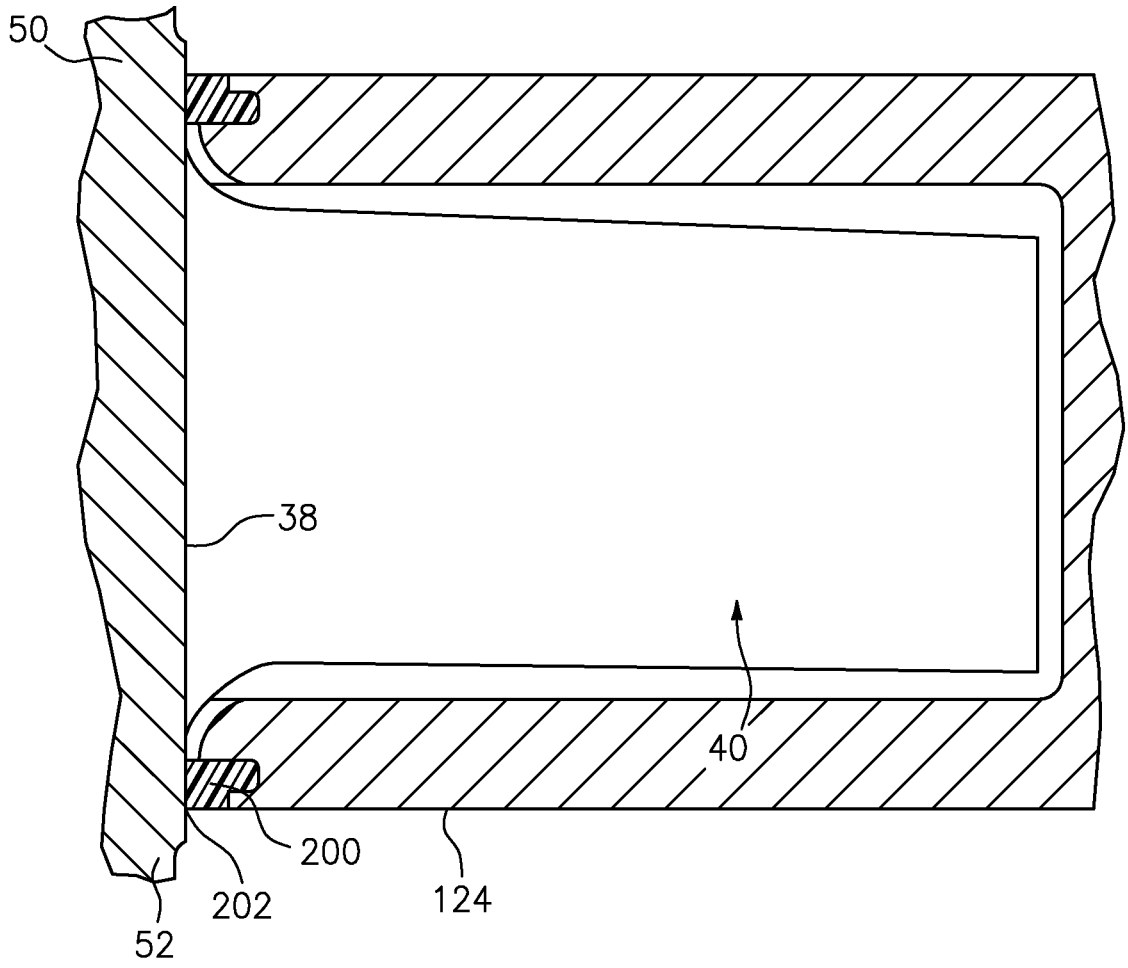
FIG. 3D is a view of the portion of the mask assembly of FIG. 3B after maskant trimming.

An exemplary use situation involves initial manufacture of the disk by conventional means. For example, this may involve a powder metallurgical (PM) forging followed by machining. In this example, after machining and any other surface treatment (e.g., peening), the blades and the adjacent portion 34 of the rim are super-polished. Thereafter, the mask assembly is installed. The segments are assembled around the blades and bolted together. The sections of the mask are then secured in place (e.g., tightening down of the bolts). Liquid maskant (e.g., a quartz silica-filled vinyl polydimethylsiloxane such as Paradigm™ VPS impression material from 3M ESPE, St. Paul, Minn.) is then introduced into the rebate (e.g., via a gun) by hand or robot. FIG. 3C shows as-applied maskant 200. After curing/hardening, the maskant 200 is trimmed (e.g., via a razor blade or the like) to present a clean edge 202 at the adjacent surface of the rotor (FIG. 3D). The exposed surface of the rotor may then be prepared for receiving a bondcoat. Exemplary preparation involves grit blasting. During the grit blasting, the mask and maskant protect the blades and adjacent areas. After grit blasting, there may be a cleaning to remove residue from the blasting process. Thereafter, the bondcoat may be applied. Exemplary bondcoat application involves plasma spray of an MCrAlY bondcoat. After bondcoat application, the maskant 200 may be removed. This may be achieved by disassembling the section 70 and pulling the remaining maskant off of whichever of the section 70 and the rotor that it may be sticking to.

Thereafter, the section 70 may be reassembled for application of a ceramic thermal barrier coat (TBC) atop the bondcoat. The exemplary TBC is applied without reapplying maskant. This allows the TBC to slightly feather beyond the bondcoat. In the absence of the maskant, the rebate 140 serves as a shadow mask causing a tapering thickness of ceramic to be deposited on the rotor within the rebate. Exemplary ceramic application is performed at elevated temperature. For example, the rotor may be preheated to a temperature of 800° F. to 900° F. (427° C. to 482° C.). At this temperature range, polymeric maskants may fail. Particularly during the ceramic coating, the aforementioned shadow mask effect may reduce or eliminate bridging between the rotor and mask. With bridging, there is a danger of cracking or chipping when the mask is removed.

Although mask section 70 is shown forming an annular channel, variations on such a mask section 70 may lack one of the flanges 90, 92. For example, the geometries of the aforementioned mask flanges may be applied when only one side of the blade array is masked at a given time (e.g., in place of a single masking lip as is used in the '138 publication). Such features might also be used to mask at locations other than integral blades (e.g., at locations such as those shown in the '864 publication).

The exemplary mask assembly or other variations thereon may have one or more advantages over alternative masking systems. A first possible advantage is the ability to use the same basic mask structure for one or more distinct stages (i.e., grit blasting, bond coat application, and ceramic coat application in the aforementioned example). Other potential benefits involve performance within each of the individual stages. The use of a curable material to span a small gap between the mask and part allows for a combination of manufacturing tolerances in the part and/or mask as well as allowing for slight wear, temporary thermal distortion, and any permanent thermal distortion/warping.

Figure 4:
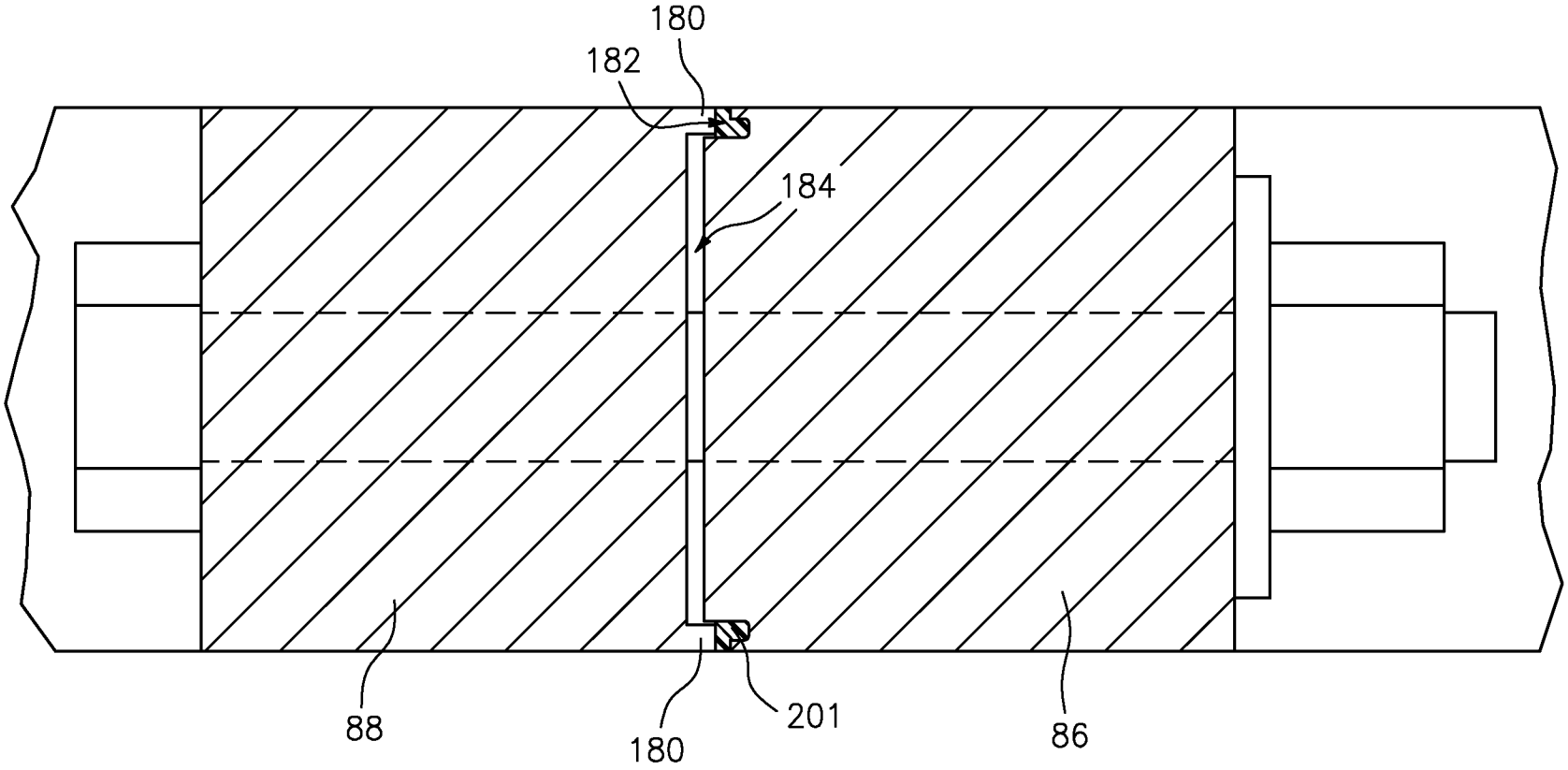
FIG. 4 is a sectional view of a joint between mask sections taken along line 4-4 of FIG. 2.

FIG. 4 is a sectional view of a joint between mask sections. As a further variation, it shows shiplap features in the form of longitudinally outboard ribs 180 on one or both of the ears 86 and 88 nesting in grooves (e.g., rectangular section or quarter round grooves receiving complementarily-shaped ribs) 182 in the other. In this example, both ribs 180 are on one of the flanges and both grooves 182 are on the other.

In one exemplary sizing, the segments 80 are sized so that the relaxed radius of curvature at their inboardmost location 134 is slightly greater than the adjacent disk radius of curvature (half of $D_0$). However, each segment has its end faces slightly less than 120° of arc spaced apart. This allows the assembled segments to initially locally contact the rotor at approximately the center of the circumferential span of the segments. The curvature of the surface 130 allows a continuous extended contact of the cross-sections of the mask and fillets 133. The radial gaps between the segments and the rotor expand out from the center of each segment toward its ends. Tightening of the segments may fully or partially close this gap. At the inter-segment joint, the segments may fully bottom out against each other or an inter-segment gap 184 (FIG. 4) may be left. With such a gap, the interfitting of the ribs 180 and rebates 182 helps maintain mask integrity. This allows the mask to accommodate slight variances in disk diameter and roundness and allows slight variances in mask diameter and roundness. The plates 91 of FIG. 2 may have a height sufficient to cover at least a central portion of the gap between the rebates 182. The spaces between each rebate and its associated rib may be filled with a portion of 201 of the maskant.

Alternatively, a controlled mask to part gap can be achieved by sizing the channel depth to bottom out the inboard surface of the band portion 94 on the airfoil tips.

Particularly during the ceramic coating, the aforementioned shadow mask effect may reduce or eliminate bridging.

The use of integral insulating features may facilitate passive part temperature control. In order to achieve the desired coating physical properties and residual stress state, it is desirable to control the part temperature during coating application. For example, a target control range may be to 800° F. to 900° F. (427° C. to 482° C.). It is desirable to achieve this part temperature by heating with the spray torch. The part temperature increases during preheat rapidly at first and with time approaches an equilibrium temperature as the rate of heat loss to the environment approaches the heat input rate. This equilibrium temperature is influenced by the design of insulators 102, 112. The amount of insulation provided is chosen so that equilibrium temperature during coating application is within the desired range.

As is discussed above, segmenting one or both of the metallic portions of the rings (e.g., the aforementioned splitting of the ring portions of mask 74 into separate rings 108 and 110) reduces distortion during elevated temperature processing. During preheat the part and masking features are heated on their outer diameter and heat is driven into the mass of the part by thermal gradient as it comes up to temperature. This thermal gradient may be intentionally increased by using high power or close standoff conditions for all or some of the preheat operation. This thermal gradient diminishes as the internal part temperature rises and equilibrium is approached prior to or during coating. Even at equilibrium temperature thermal gradients still exist due to variation in heat input and heat loss rates over the part and masking surfaces. These gradients cause differential thermal expansion of a monolithic ring that cause distortion and can potentially expose regions of the part where coating is not permitted. By providing a thermal and mechanical break between the disk-shaped axial end covers (insulators) 102, 112 and the shiplap mask rings 100, 110, the thermal gradients in the shiplap mask rings are reduced. A lower thermal gradient results and mask distortion minimized.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. An assembly of a component and a mask for masking the component at an annular boundary, the component comprising:

an integrally-bladed rotor (22) comprising:

a disk bore (28);

a rim (32) having an outer diameter (OD) surface (38);

a web (30) extending radially outward from the bore to the rim; and a circumferential array of blade airfoils (40) extending from the outer diameter surface to respective tips (42), and the mask comprising a wall (90, 92) having:

an inner first rim portion having a first inner diameter ($D_1$);

an outward rebate (140) open axially outward adjacent the inner first rim portion; and a second rim portion (146) having a second inner diameter ($D_3$), the second inner diameter larger than the first inner diameter and the outward rebate having an inwardly-open channel (142) open radially inward between the inner first rim portion and the second rim portion.

2. The assembly of claim 1 wherein:

the inner first rim portion has a convex arcuate longitudinal cross-section.

3. The assembly of claim 1 wherein:

the wall is a first wall (90);

the mask has a second wall (92), axially spaced apart from the first wall; and the second wall has:

an inner first rim portion having a first inner diameter ($D_1$); and an outward rebate adjacent the second wall inner first rim portion.

4. The assembly of claim 3 wherein:

an outer band (94) joins the first wall to the second wall.

5. The assembly of claim 1 wherein:

the mask comprises a plurality of segments (80) secured end-to-end.

6. The assembly of claim 5 wherein:

at joints between respective ends of one said segment and another said segment, the segments have interfitting ribs (180) and rebates (182).

7. The assembly of claim 1 wherein:

the mask is radially compressively engaged to the component at at least three circumferentially spaced locations.

8. The assembly of claim 1 further comprising:

a sealant (200) between the mask and the component to seal the mask to the component.

* * * * *